United States Patent [19]

Moore

[11] 4,005,715

[45] Feb. 1, 1977

[54] MATERNITY SUPPORTER

[76] Inventor: Robert G. Moore, 635 Spar Drive, Redwood City, Calif. 94065

[22] Filed: Jan. 19, 1976

[21] Appl. No.: 650,198

[52] U.S. Cl. ..... 128/579 R

[51] Int. Cl.[2] ..... A41C 1/08

[58] Field of Search ..... 128/78, 579 R, 579 B, 128/518 R, 540, 520, 578, 537, 540, 566

[56] References Cited

UNITED STATES PATENTS

| | | | |
|---|---|---|---|
| 284,831 | 9/1883 | Galny | 128/579 R |
| 3,273,563 | 9/1966 | Borang | 128/579 R |
| 3,282,264 | 11/1966 | Connelly | 128/78 |

*Primary Examiner*—G. V. Larkin
*Attorney, Agent, or Firm*—Edward B. Gregg

[57] ABSTRACT

The maternity supporter comprises a narrow strip of contoured elastic material having continuous harness straps at either end. VELCRO hooks are located at the inside ends of the straps, with receiving pile portions located further down on the outside of the straps. The maternity supporter is designed to be worn over undergarments by placing the narrow strip around the lower part of the abdomen, crossing the straps behind the back, and stretching them over the shoulders and toward the sides, where the hooks from one strap are then readily applied to the pile portions of the opposite strap.

7 Claims, 8 Drawing Figures

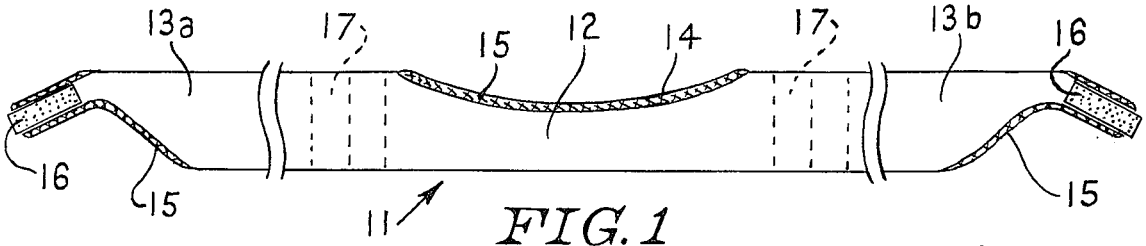
FIG. 1
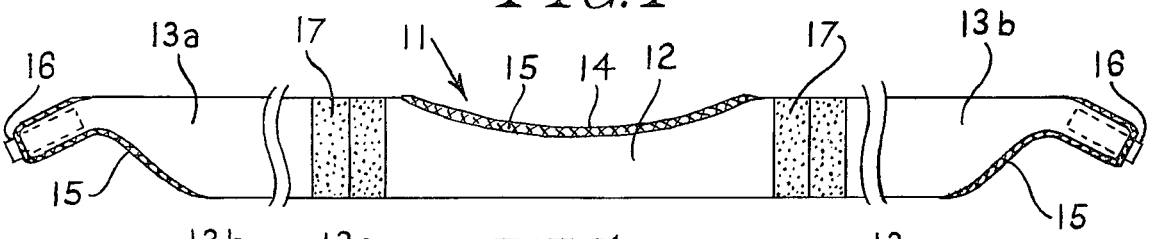
FIG. 2
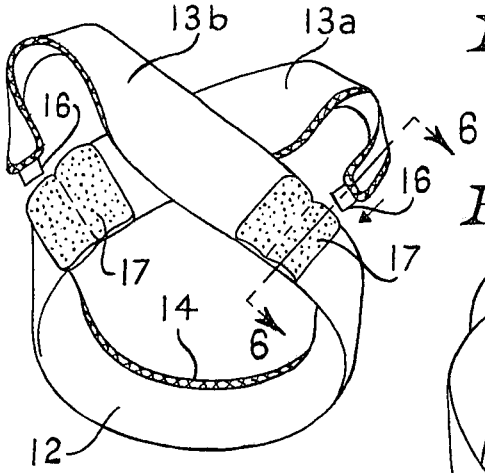
FIG. 3
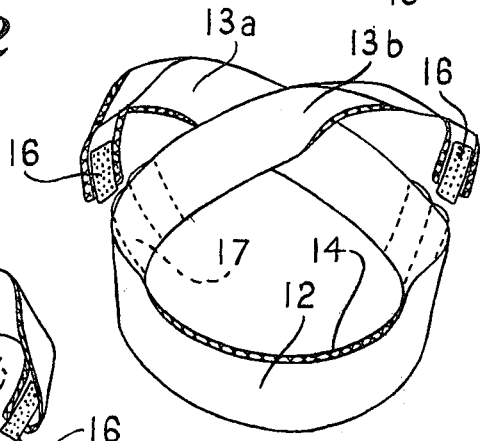
FIG. 4
FIG. 5
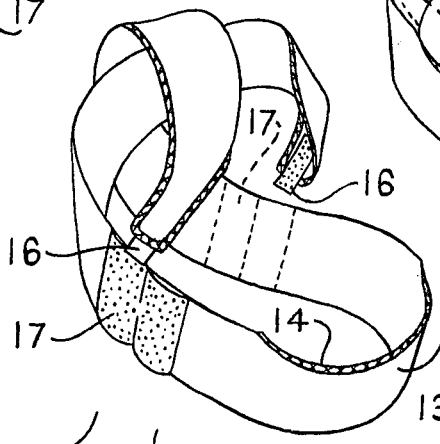
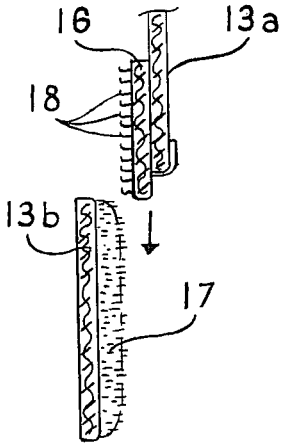
FIG. 6
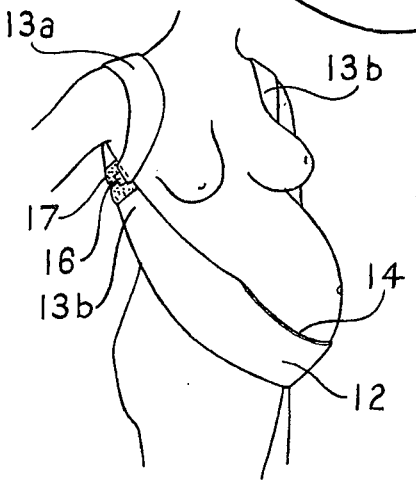
FIG. 7
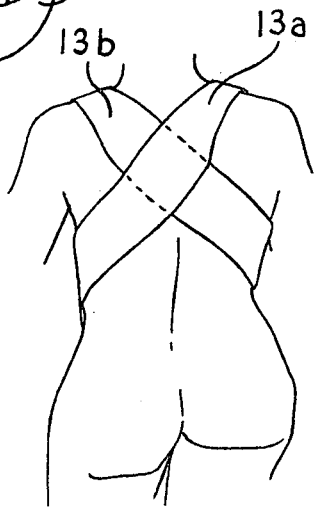
FIG. 8

MATERNITY SUPPORTER

PRIOR ART

A variety of maternity supporters have been devised for providing support for the uterus during pregnancy. Such supporters utilize girdles or pouches, fitting around the abdomen, together with a number of straps, including shoulder straps, for both securing the girdle or pouch in place, and, as well, for providing uplift for the uterus. Most of such girdle-like supporters utilize the shoulder straps as a sole means of support, and as a result have required so many straps, buckles, snaps and the like, as to be awkward to put on and take off. Some even require assistance from another person in putting them on and taking them off. Other models have been found to be uncomfortable, especially where straps must pass between the wearer's legs.

More recently, a maternity girdle has been devised which utilizes a pouch as well as a continuous attached harness, both of which serve to provide support. This arrangement, although eliminating the multiplicity of straps found in earlier girdles, still requires both a girdle and a harness structure, resulting in three areas of attachment, namely, the two straps and the waistband of the pouch. As well, there results a considerable area of the girdle in contact with, and possibly irritating, the body of the wearer. Moreover, the harness strap of such device is so aligned vertically as to come into considerable contact with the outside of the breasts, with possible objectionable pressure here. Also, the pouch of such device, though providing excellent support, tends to compress the abdomen, whereas unrestricted enlargement in this area is considered medically advisable.

OBJECTS

It is a primary object of this invention to provide a maternity supporter which will materially relieve pressure and pain in the lower pelvic and back areas without causing undue restriction or compression of the abdomen.

Another object of the invention is to provide a maternity supporter which can be easily put on and taken off by the wearer without using numerous or awkward means of attachment.

Another object of the invention is to provide a maternity supporter which will substantially relieve pain and pressure in the lower back area during the latter stages of pregnancy.

Another object of the invention is to provide a maternity supporter which can be comfortably worn over undergarments.

A further object of the invention is to provide a maternity supporter having only two points of attachment to secure the supporter in place.

A further object of the invention is to provide a maternity supporter having straps aligned so they do not impinge upon the breasts.

A further object of the invention is to provide a maternity supporter which contacts only the lower half of the abdomen.

A still further object of the invention is to provide an inexpensive maternity supporter which can be machine washed and dried.

INVENTION

The maternity supporter of this invention comprises a strip of elastic material formed to fit around and to provide support for the lower half of the abdomen. The strip, having a width of about 6 inches, is formed continuously with harness straps at either end, the straps being of sufficient length such that when the strip is placed in supporting position around the lower part of the abdomen, the straps can be drawn behind the wearer's back, crossed over one another, and stretched over the shoulders and toward the side of the body, away from the breasts. Fastening means are located on the ends of the harness straps so that when they are stretched over the shoulder, the end of each strap can be fastened to the opposite strap, in the vicinity of the wearer's armpits.

The preferred fastening means comprises VELCRO fasteners, consisting of coacting hook-and-pile strips attached to the harness straps, with the hook portions attached to the inside of the harness straps and the pile portions attached to the outside of the straps. The pile portion of the fastener is positioned on each strap at a point far enough up the straps so that when the hook portion of the strap is secured to it, that portion of the strap coming over the shoulder will be as close to the shoulder as possible and therefore will not contact or unduly restrict either breast.

The total length of the maternity supporter including the straps, will preferably be about 77 inches, although longer or shorter models may be desirable depending upon the size of the wearer. Preferably, the width of the supporter is about 6 inches, as to both the strip and the straps. This preferred width allows optimum weight distribution, so that the load will be adequately spread over the shoulders.

Another preferred feature of the supporter is the shallow cut-out portion of the upper edge of the strip, contoured to comfortably fit the abdomen at the upper edge when the strip is in place. As noted above, the VELCRO hooks are fastened to the inside ends of each strap, with the pile portions secured to the outside surfaces of the straps at about where the strap runs into the strip portion of the supporter.

REFERENCE TO THE DRAWINGS

FIG. 1 is a view of the maternity supporter of this invention in open position and showing the inner side of the supporter.

FIG. 2 is a view of the outer side of the maternity supporter.

FIG. 3 is a rear elevational view of the maternity supporter.

FIG. 4 is a side elevational view of the maternity supporter.

FIG. 5 is a front elevational view of the maternity supporter.

FIG. 6 is a cross-sectional side view of the hook-and-pile fastener as shown in FIG. 3.

FIG. 7 is a front view of the maternity supporter secured in place.

FIG. 8 is a rear view of the maternity supporter in place showing the crossed straps in back.

DESCRIPTION OF PREFERRED EMBODIMENT

As shown in FIGS. 1 and 2, the preferred maternity supporter 11 of this invention comprises a narrow elastic strip 12 of about 6 inches in width which is continuous with the two harness straps 13*a*, 13*b*, formed of the same elastic material. The upper edge 14 of the strip is contoured to fit the abdomen and may be formed with a hem 15 to provide additional comfort for the wearer. Velcro hook portions 16 are attached to the inside of the ends of the straps 13*a*, 13*b*, as shown in FIG. 1, whereas the pile portions 17 of the fasteners are shown in relief. In FIG. 2, the hook portions 16 are partly in relief, whereas the pile portions 17 are in full view.

The attachment angle of the hook-and-pile portions of the VELCRO fasteners 16, 17 is best illustrated by FIG. 3, showing an elongated rear view of the maternity supporter 11. FIGS. 4 and 5 further illustrate the crossing of the straps 13*a*, 13*b* and the angle of attachment of the fasteners 16, 17.

In FIG. 6, the hook portion 16 of the fastener, containing numerous hooks 18, is secured to the end of the strap 13*a*. The hook portion 16 is moved in the direction of the arrow and engaged with the pile portion 17 attached to the other strap 13*b*, such engagement providing a simple and firm fastening. Release of the secured hooks 18 is accomplished by again moving the end of the strap 13*a* in the direction of the arrow until the hooks 18 release from the pile 17.

The maternity supporter in place is shown in FIG. 7, where the left strap 13*a* has been fastened by securing the hook portion 16 to the pile portion 17 of the opposite strap 13*b*. It is noted that the pile portion 17 is located on the strap 13*b* at a point on the strap near the armpit, such that the opposite strap 13*a* coming over the shoulder will not unduly restrict or impinge upon the adjacent breast. FIG. 7 also illustrates the angle of support of the contoured strip 12 as it contacts the lower half of the abdomen. It will be seen that the upper half of the abdomen, as well as both breasts, will be completely unrestricted.

The strap 13*a* shown in secured position in FIG. 7 can be seen in FIG. 8 as it crosses over the other strap 13*b* before it stretches over the wearer's right shoulder.

The extreme simplicity of design of the maternity supporter of this invention, as shown in the open position in FIGS. 1 and 2, as well as in the elongated and in-place positions in the subsequent figures, gives it the double advantage of being both easy to put on and take off while also leaving the breasts and abdomen completely unrestricted. It is noted that there are only two points of attachment, both of which are in the vicinity of the wearer's armpits. Buckles, snaps and conventional hooks are not required. The wearer, without any assistance at all, need only exert gentle pressure to engage or disengage the hook portion 16 from the pile portion 17 of the straps 13*a*, 13*b*, an action that can be accomplished with an easy motion of one hand. The maternity supporter is designed to be worn over under garments, though them as well. The contoured upper edge 14, as shown in FIG. 7, prevents the upper edge of the supporter from cutting into the wearer's abdomen. Also, the placement of the pile portion 17 of the fastener near the wearer's armpits further adds to the comfort of the wearer by eliminating pressure of the straps on the breasts.

The maternity supporter of the present invention is thus seen to be superior to existing supporters for a number of reasons. First of all, it provides support for the uterus during pregnancy to relieve pressure and associated pain in the lower pelvic and back areas, and it does so with a minimum of discomfort for the wearer. Secondly, because the maternity supporter utilizes only two points of attachment, and fasteners requiring only the slightest attention, it can be put on and taken off by the wearer with great ease. As noted, a minimum pressure is exerted upon the abdomen, since only slight uplift of the abdomen is caused by the harness straps, and the breast area is completely unrestricted. Furthermore, the supporter can be inexpensively manufactured and is machine washable and dryable.

The maternity supporter of this invention may preferably be used to relieve pressure and pain in the lower pelvic and back areas during the latter stages of pregnancy, i.e. from 6 months to birth. However, the supporter can be utilized earlier, if needed.

I claim:

1. A maternity supporter comprising a strip of elastic material formed to fit around and provide support for the lower half of the abdomen, the strip having elastic harness straps at either end, said straps being of sufficient length such that when the strip is placed in supporting position around the lower portion of the abdomen, the straps can be drawn behind the wearer's back, crossed over one another, and stretched over the shoulders and toward the sides of the body; and fastening means located on the harness straps so that when the straps are stretched over the shoulders, each strap can be fastened to the opposite strap, whereby comfortable support and uplift is provided for the abdomen.

2. The maternity supporter of claim 1 wherein the strip and harness straps are formed of a continuous piece of the elastic material.

3. The maternity supporter of claim 1 wherein the strip of the supporter has a width of approximately 6 inches, and the total length of the supporter is approximately 77 inches.

4. The maternity supporter of claim 1 wherein the upper edge of the strip is formed with a concave shape and is hemmed to prevent the upper edge from cutting into the wearer's abdomen.

5. The maternity supporter of claim 1 wherein the fastening means comprises VELCRO hook-and-pile fasteners with hook portions secured to the inner ends of the straps and pile portions secured at a point on the outside of the straps in the vicinity of the wearer's armpits, when the supporter is in place.

6. The maternity supporter of claim 1 wherein the edges of the straps have hems where the straps are stretched over the shoulders, to prevent the straps from cutting into the shoulders.

7. A one-piece maternity supporter comprising a strip of elastic material contoured to fit comfortably around the lower half of the abdomen, the strip having a width of about 6 inches and being formed continuously with harness straps on either end, the harness straps being of sufficient length such that when the strip is placed in supporting position around the lower part of the abdomen the straps can be drawn behind the wearer's back, crossed over one another and stretched over the shoulders and toward the sides of the body; and VELCRO hook-and-pile fasteners secured to the straps, with the hook portions secured to the inside ends of the straps and the pile portions secured to the outside of the straps at a point where the positioned straps approach the wearer's armpits, whereby comfortable support and uplift is provided for the abdomen.

* * * * *